US006896210B2

(12) United States Patent
Reiter et al.

(10) Patent No.: US 6,896,210 B2
(45) Date of Patent: May 24, 2005

(54) FUEL INJECTION VALVE

(75) Inventors: Ferdinand Reiter, Markgroeningen (DE); Ottmar Martin, Pettstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/240,462

(22) PCT Filed: Jan. 28, 2002

(86) PCT No.: PCT/DE02/00296

§ 371 (c)(1),
(2), (4) Date: May 13, 2003

(87) PCT Pub. No.: WO02/061270

PCT Pub. Date: Aug. 8, 2002

(65) Prior Publication Data

US 2003/0168530 A1 Sep. 11, 2003

(30) Foreign Application Priority Data

Jan. 30, 2001 (DE) ..... 101 03 932

(51) Int. Cl.[7] ..... B05B 1/30
(52) U.S. Cl. ..... 239/585.1; 239/585.5
(58) Field of Search ..... 739/585.1, 585.2, 739/585.3, 585.4, 585.5

(56) References Cited

U.S. PATENT DOCUMENTS

| | | | | | |
|---|---|---|---|---|---|
| 4,982,902 | A | * | 1/1991 | Knapp et al. | 239/585.3 |
| 5,884,850 | A | * | 3/1999 | Norgauer | 239/585.5 |
| 6,027,049 | A | * | 2/2000 | Stier | 239/585.1 |
| 6,123,275 | A | | 9/2000 | Geiger et al. | |
| 6,357,676 | B1 | * | 3/2002 | Hanft | 239/585.1 |

FOREIGN PATENT DOCUMENTS

| | | | |
|---|---|---|---|
| DE | 195 03 821 | | 8/1996 |
| EP | 0 781 916 | | 7/1997 |
| WO | WO 00/32926 | * | 6/2000 |

* cited by examiner

*Primary Examiner*—Christopher Kim
(74) *Attorney, Agent, or Firm*—Kenyon & Kenyon

(57) ABSTRACT

A fuel injector for direct injection of fuel into a combustion chamber of a mixture-compressing, spark-ignited internal combustion engine, has a nozzle body that forms a housing body with an external pole and a coil housing, a magnet coil that is electrically energizable by way of a lead and a plug contact, and a central fuel supply. The lead and the fuel supply are positioned together in an adapter that can be placed onto an inflow end of the housing body and is joinable thereto.

7 Claims, 2 Drawing Sheets

FUEL INJECTION VALVE

FIELD OF THE INVENTION

The present invention relates to motor vehicle engines and in particular, but without limitation, relates to fuel injection.

BACKGROUND INFORMATION

In conventional electromagnetically actuable fuel injectors, a valve tube that constitutes the basic element of the fuel injector is made up of three parts. A core and a valve seat support are joined to one another in hydraulically sealed fashion via a nonmagnetic spacer using at least two fitting and joining points.

German Published Patent Application No. 195 03 821 describes a fuel injector in which the number of components of the valve tube is decreased, so that the number of joining and fitting points is also reduced. The entire valve tube is fabricated from magnetically conductive material, so that magnetically nonconductive spacers can be dispensed with.

A disadvantage of the fuel injector known from German Patent Application No. 195 03 821 is that the housing shape of this fuel injector is not suitable for some applications in the context of direct fuel injection, since it is too short in terms of the existing installation situation and is not sufficiently sealed with respect to the engine compartment.

SUMMARY OF THE INVENTION

The fuel injector according to the present invention has the advantage that individual lines that ensure the supply of electricity and of fuel are guided in an adapter that lengthens the fuel injector, such that the unit is sealed overall against the pressure in the intake manifold and/or in the combustion chamber. Installation is thereby also facilitated, since the supply lines are more easily accessible and are all positioned at one point.

It is also advantageous that the adapter is constructed from two easily manufactured tubular hollow bodies that can be inserted into one another.

It is also advantageous that the adapter can be attached onto the fuel injector before welding, which simplifies final assembly.

Advantageously, the fuel supply is provided in the one hollow body and the electrical lead in the other hollow body, so that the electrical lead can be routed easily and protected against damage.

It is also advantageous that any desired fuel injectors can be equipped with the adapter according to the present invention.

DETAILED DESCRIPTION

Figure 1:
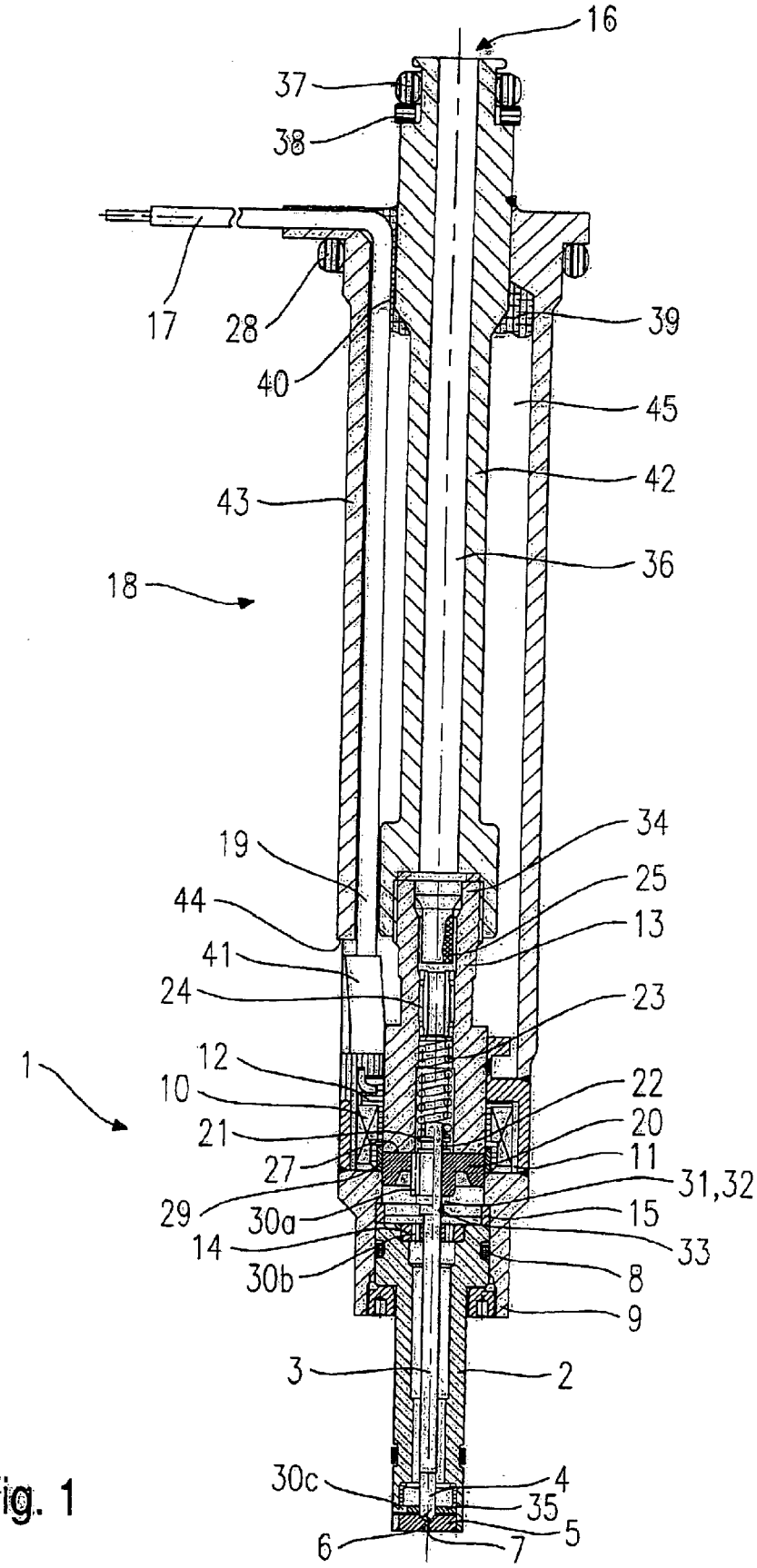
FIG. 1 is a schematic section through an exemplified embodiment of a fuel injector configured according to the present invention.

FIG. 1 shows, in a partial and schematic sectioned depiction, a longitudinal section through an exemplified embodiment of a fuel injector 1 configured according to the present invention.

Fuel injector 1 is embodied in the form of a fuel injector for fuel injection systems of mixture-compressing, spark-ignited internal combustion engines. Fuel injector 1 is suitable in particular for direct injection of fuel into a combustion chamber (not depicted) of an internal combustion engine.

Fuel injector 1 has a nozzle body 2 in which a valve needle 3 is positioned. Valve needle 3 is in working engagement with a valve-closure member 4 which coacts with a valve-seat surface 6, positioned on a valve-seat member 5, to form a sealing seat. In the exemplified embodiment, fuel injector 1 is an inward-opening fuel injector 1 that possesses at least one spray discharge opening 7. Nozzle body 2 is sealed by a seal 8 with respect to external pole 9 of a magnetic circuit. A magnet coil 10 is encapsulated in a coil housing 11 and wound onto a coil support 12 that rests against an internal pole 13 of the magnetic circuit. Internal pole 13 and external pole 9 are separated from one another by a gap 26, and are supported on a connecting component 29. Magnet coil 10 is energized, via a lead 19, by an electrical current that can be conveyed via an electrical plug contact 17. According to an embodiment of the present invention, lead 19 is positioned in an adapter 18 that is inserted via an inflow end 34 of fuel injector 1 and which may be welded to fuel injector 1 in the region of magnet coil 10. Lead 19 is connected in electrically conductive fashion, such as via a plug connector 41, to magnet coil 10.

Fuel is delivered via a central fuel supply 16 that is configured in an opening 36 of adapter 18 guided parallel to lead 19, and is filtered through a filter element 25 in inflow end 34 of fuel injector 1. Fuel injector 1 is sealed by way of a first seal 28 with respect to a cylinder head that is not depicted further, and by way of a second seal 37 with respect to a fuel line that is also not depicted further.

Adapter 18 is made up of two tubular hollow bodies 42 and 43 guided within one another: inner hollow body 42 conveys fuel out of the fuel line (not depicted) from central fuel supply 16 to filter element 25, while outer hollow body 43 receives lead 19 and inner hollow body 42.

Valve needle 3 is guided in a valve needle guide 14 that is of disk-shaped configuration. An adjusting disk 15 paired thereto serves to adjust the linear stroke. Located on the other side of adjusting disk 15 is an armature 20. The latter is joined via a first flange 21 to valve needle 3, which is joined to first flange 21 by way of a weld seam 22. Braced against first flange 21 is a return spring 23 which, in the present configuration of fuel-injector 1, is preloaded by a sleeve 24.

A second flange 31, which is joined to valve needle 3 via a weld seam 33, serves as the lower armature stop. A flexible spacer ring 32, which rests on second flange 31, prevents bouncing when fuel injector 1 closes.

Configured on the inflow side of the sealing seat is a guidance disk 35 that ensures centered alignment of valve needle 3 and thus counteracts any tilting of valve needle and subsequent inaccuracies in the metered fuel quantity. Fuel conduits 30*a* through 30*c* extend in valve needle guide 14, in armature 20, and in guidance disk 35.

When fuel injector 1 is in the idle state, armature 20 is impinged upon opposite to its linear stroke direction by return spring 23 so that valve-closure member 4 is held in sealing contact on valve seat 6. Upon energization of magnet coil 10, the latter establishes a magnetic field that moves armature 20 in the linear stroke direction against the spring force of return spring 23, the linear stroke being defined by a working gap 27 that is present, in the idle position, between internal pole 13 and armature 20. Armature 20 also entrains flange 21, which is welded to valve needle 3, in the linear stroke direction. Valve-closure member 4, which is in working engagement with valve needle 3, lifts off from valve-seat surface 6, and fuel is discharged.

When the coil current is shut off and once the magnetic field has decayed sufficiently, armature 20 falls away from internal pole 13 as a result of the pressure of return spring 23, thereby moving flange 21, which is in working engagement with valve needle 3, against the linear stroke direction. Valve needle 3 is thereby moved in the same direction, so that valve-closure member 4 is placed onto valve-seat surface 6 and fuel injector 1 is closed.

Sealing of adapter 18 against the pressure of the combustion chamber and the intake manifold is accomplished, during the assembly of fuel injector 1, in three different ways. Firstly the housing of fuel injector 1, constituted by nozzle body 2 and by external pole 9 of magnet coil 10, is fitted together and sealed against the external pressure by means of seal 8 positioned therebetween. The join between coil housing 11 and external pole 9 may be accomplished by welding, as is the join between coil housing 11 and adapter 18. Alternatively, coil housing 11 can also be configured integrally with adapter 18, so that one less fitting point occurs. Sealing against the pressure in the intake manifold and/or in the combustion chamber, as already mentioned above, is accomplished via first seal 28, whereas second seal 37 in combination with a backing washer 38 seals against the pressure in the fuel line.

Seals 8, 28, and 37 may be implemented as O-rings, which can be produced economically and in a manner resistant to influences such as heat or the dissolving characteristics of fuel. A recess 45 formed between inner hollow body 42 and outer hollow body 43, as well as other gaps 40 that occur, are filled with a sealing compound 39 and thus also sealed.

Figure 2:
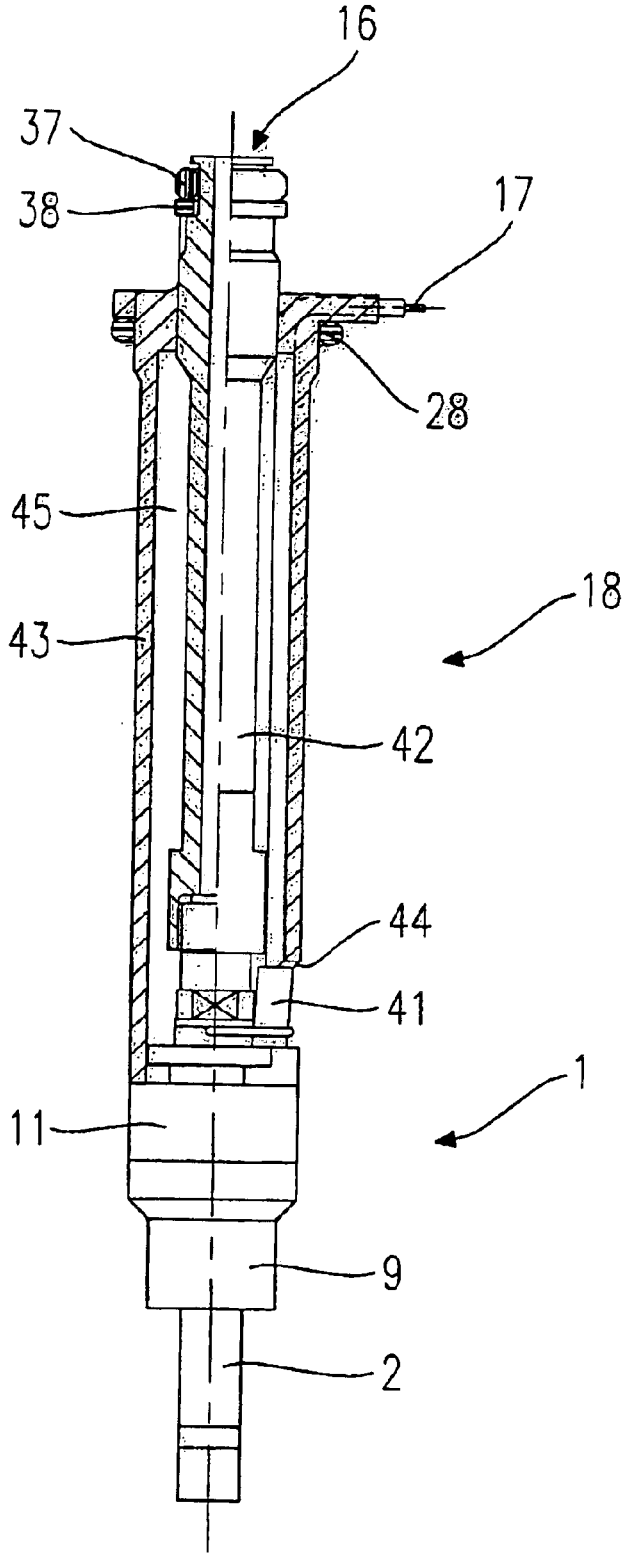
FIG. 2 is a schematic partial section through the fuel injector according to an embodiment of the present invention.

FIG. 2 shows fuel injector 1 configured according to the present invention, in a further schematic view that is only partially sectioned.

In order to illustrate the features according to the present invention, the outflow-end portion of fuel injector 1 is shown unsectioned. The housing parts that are joined to one another—nozzle body 2, external pole 9, and coil housing 11—are evident. Positioned at the inflow end of coil housing 11 is adapter 18, which is shown partially sectioned. The right side of the drawing shows inner hollow body 42 unsectioned, to illustrate that it can be easily slipped onto inflow end 34 of fuel injector 1. Outer hollow body 43, which is depicted in section, terminates flush with coil housing 11, a shoulder 44 being provided on the side of plug connection 41 in order to keep plug connection 41 externally accessible. Recess 45 between inner hollow body 42 and outer hollow body 43, and gaps 40 proceeding therefrom, are filled with sealing compound 39, so that easily implemented sealing can be accomplished particularly in the critical region of the fuel supply conduit and the electrical contacts.

The invention is not limited to the exemplified embodiment depicted and is also applicable, for example, to fuel injectors 1 having magnetostrictive or piezoelectric actuators 10, and to fuel injectors 1 of any configuration.

What is claimed is:

1. A fuel injector, comprising:

a housing body including a nozzle body, an external pole, and an inflow end;

a plug contact;

a lead;

an actuator that is electrically energizably via the plug contact and the lead;

a central fuel supply conduit; and an adapter capable of being slipped on to the inflow end of the housing body, wherein:

the lead and the central fuel supply conduit are positioned in the adapter, the adapter includes an inner hollow body and an outer hollow body, the inner hollow body includes an opening and fuel is conveyed through the opening in the inner hollow body, the inner hollow body is positioned in a recess of the outer hollow body, and the lead is positioned in the recess.

2. The fuel injector according to claim 1, wherein the fuel injector is used for direct injection of fuel into a combustion chamber of a mixture-compressing, spark-ignited internal combustion engine.

3. The fuel injector according to claim 1, wherein the actuator includes a magnetic coil and the adapter is welded to the housing body.

4. The fuel injector according to claim 1, wherein the recess is filled with a sealing compound for sealing.

5. The fuel injector according to claim 1, wherein the adapter is sealed using a first seal.

6. The fuel injector according to claim 5, wherein the adapter is sealed from a fuel line by a second seal.

7. The fuel injector according to claim 6, wherein the first seal and the second seal include O-rings.

* * * * *